US010908552B2

(12) United States Patent
Yoshioka

(10) Patent No.: US 10,908,552 B2
(45) Date of Patent: Feb. 2, 2021

(54) IMAGE FORMING DEVICE AND METHOD FOR DETERMINING ABNORMALITY

(71) Applicant: Yu Yoshioka, Tokyo (JP)

(72) Inventor: Yu Yoshioka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/809,930

(22) Filed: Mar. 5, 2020

(65) Prior Publication Data

US 2020/0292980 A1 Sep. 17, 2020

(30) Foreign Application Priority Data

Mar. 12, 2019 (JP) ..... 2019-044741

(51) Int. Cl.
*G03G 21/00* (2006.01)
*G03G 15/00* (2006.01)

(52) U.S. Cl.
CPC ..... *G03G 21/0005* (2013.01); *G03G 15/55* (2013.01); *G03G 21/0011* (2013.01); *G03G 2221/0005* (2013.01); *G03G 2221/0089* (2013.01)

(58) Field of Classification Search
CPC ..... G03G 15/55; G03G 21/0005; G03G 21/0011; G03G 2221/0005; G03G 2221/0089
See application file for complete search history.

(56) References Cited

U.S. PATENT DOCUMENTS 5,168,309 A * 12/1992 Adachi ..... G03G 15/0216 399/174
2004/0105710 A1* 6/2004 Shakuto ..... G03G 21/0029 399/350
2008/0232836 A1* 9/2008 Ishida ..... G03G 15/5033 399/60
2013/0169990 A1 7/2013 Yoshioka et al.
2013/0294794 A1 11/2013 Yoshioka et al.
2015/0071663 A1 3/2015 Yoshioka
2019/0146367 A1 5/2019 Yoshioka

FOREIGN PATENT DOCUMENTS

JP 2004-258419 9/2004
JP 2005-208207 8/2005
JP 2014-085441 5/2014

* cited by examiner

*Primary Examiner* — Joseph S Wong
(74) *Attorney, Agent, or Firm* — Harness, Dickey & Pierce, P.L.C.

(57) ABSTRACT

An image forming device includes a photoconductor, a motor, a charging member, a cleaning blade, and an abnormality determining unit. The motor is configured to drive the photoconductor to rotate. The charging member is configured to charge the photoconductor. The cleaning blade is configured to contact the photoconductor and remove residual toner from a surface of the photoconductor. The abnormality determining unit is configured to determine abnormality of the cleaning blade based on a motor current flowing in the motor and a gap between the photoconductor and the charging member.

5 Claims, 7 Drawing Sheets

IMAGE FORMING DEVICE AND METHOD FOR DETERMINING ABNORMALITY

CROSS-REFERENCE TO RELATED APPLICATIONS

The present application claims priority under 35 U.S.C. § 119 to Japanese Patent Application No. 2019-044741, filed on Mar. 12, 2019. The contents of which are incorporated herein by reference in their entirety.

BACKGROUND OF THE INVENTION

1. Field of the Invention

The present invention relates to an image forming device and a method for determining abnormality.

2. Description of the Related Art

In image forming devices of the electrophotographic system, a cleaning unit for bringing the tip of a cleaning blade into contact with a surface of a photoconductor driven to rotate so as to remove residual toner remaining on the surface of the photoconductor without being transferred to a transfer material is often used.

When friction between a cleaning blade and a photoconductor is excessive, the tip of the cleaning blade may be reversed following rotation of the photoconductor and abnormality referred to as blade turn-up may occur in the cleaning blade. When abnormality of blade turn-up occurs in a cleaning blade, cleaning performance is significantly degraded. Therefore, it is proposed that presence or absence of abnormality in a cleaning blade is determined based on driving torque of a motor driving a photoconductor, and, when presence of abnormality is determined, for example, an operation for putting untransferred toner and reducing friction between the cleaning blade and the photoconductor is performed so as to obtain stable cleaning performance (see Japanese Unexamined Patent Application Publication No. 2004-258419).

However, in the conventional technique described in Japanese Unexamined Patent Application Publication No. 2004-258419, presence or absence of abnormality in a cleaning blade is determined based on only driving torque of a motor. Thus, even when driving torque of a motor increases due to causes other than blade turn-up of a cleaning blade, for example, failure of a motor itself, it may be determined that abnormality occurs in the cleaning blade.

SUMMARY OF THE INVENTION

According to an aspect of the present invention, an image forming device includes a photoconductor, a motor, a charging member, a cleaning blade, and an abnormality determining unit. The motor is configured to drive the photoconductor to rotate. The charging member is configured to charge the photoconductor. The cleaning blade is configured to contact the photoconductor and remove residual toner from a surface of the photoconductor. The abnormality determining unit is configured to determine abnormality of the cleaning blade based on a motor current flowing in the motor and a gap between the photoconductor and the charging member.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENT

Figure 1:
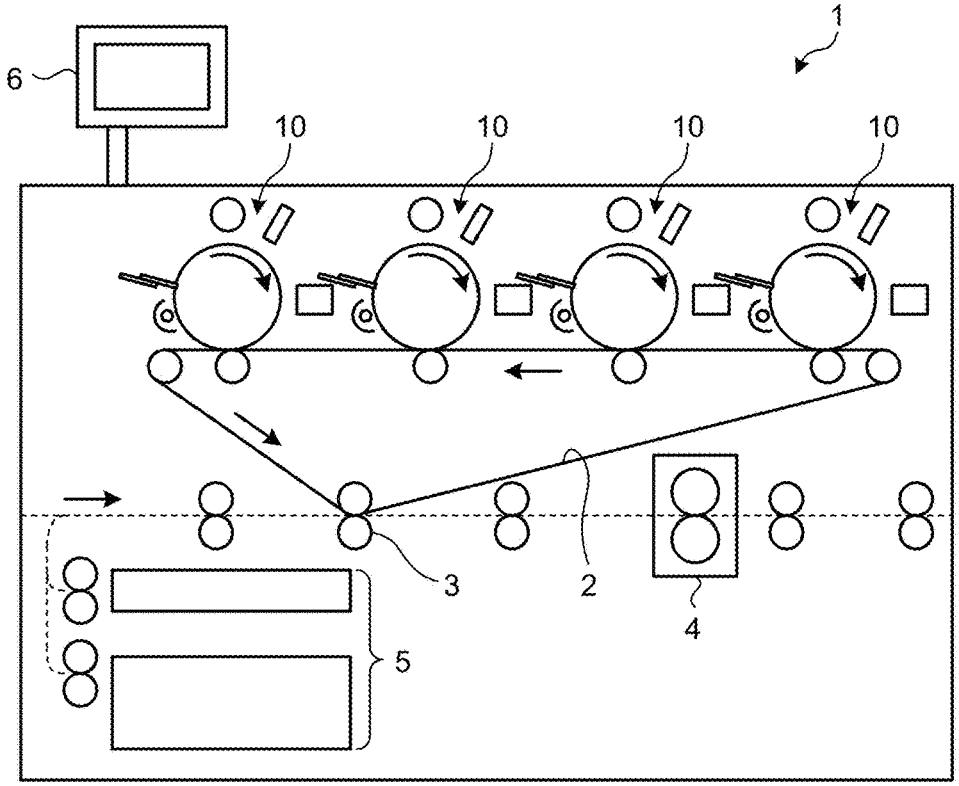
FIG. 1 is a view illustrating the schematic configuration of an image forming device.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An image forming device and a method for determining abnormality of an embodiment will be described in detail with reference to the accompanying drawings.

Figure 2:
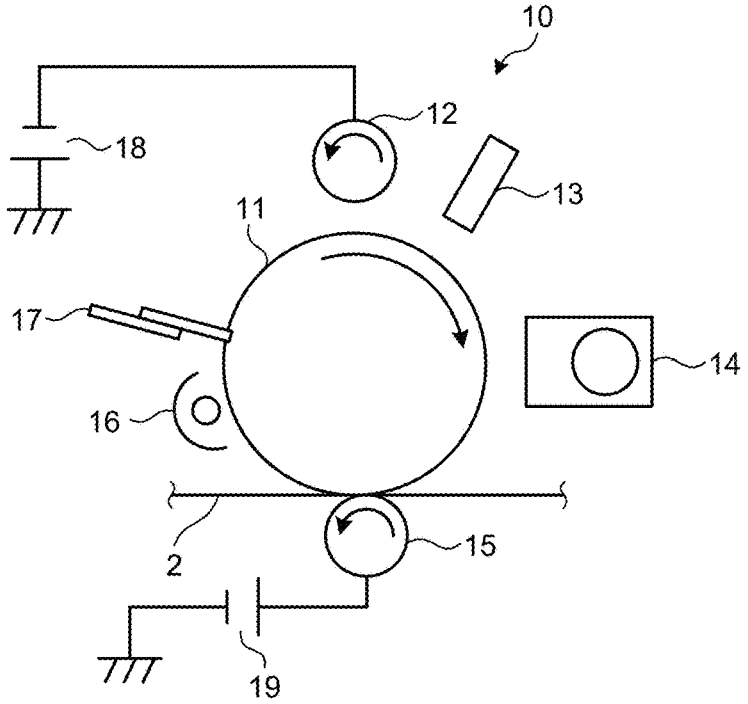
FIG. 2 is a view illustrating a specific example of an image forming unit.

The outline of the image forming device of the present embodiment will be described with reference to FIGS. 1 and 2. FIG. 1 is a view illustrating the schematic configuration of an image forming device 1 of the present embodiment. FIG. 2 is a view illustrating a specific example of an image forming unit 10. The image forming device 1 exemplified in FIG. 1 is an image forming device that forms a full-color image of four colors by the electrophotographic system, and is, specifically, an image forming device of an intermediate transfer system that transfers a toner image to a recording medium through an intermediate transfer body.

As illustrated in FIG. 1, the image forming device 1 includes the four image forming units 10 corresponding to four colors of yellow (Y), magenta (M), cyan (C), and black (K), an intermediate transfer belt 2 as an intermediate transfer body, a secondary transfer roller 3, a fixing device 4, a paper feeding tray 5, and an operation panel 6. Each of the four image forming units 10 is a unit that performs an electrophotographic process, and is arranged along with a running direction of the intermediate transfer belt 2. The four image forming units 10 have the same configuration except that the four image forming units use different toner colors.

As illustrated in FIG. 2, each of the image forming units 10 includes a photoconductive drum 11 as a photoconductor, a charging roller 12 as a charging member, an exposure device 13, a developing device 14, a primary transfer roller 15, a static eliminator 16, and a cleaning blade 17.

When an electrographic process is started, the photoconductive drum 11 starts rotating by the drive of a motor, and keeps rotating until the electrographic process ends. When the photoconductive drum 11 starts rotating, a high voltage generated by a high-voltage power source 18 is applied to the charging roller 12, and a surface of the photoconductive drum 11 is uniformly charged with a negative electrical charge. After that, the exposure device 13 irradiates the charged surface of the photoconductive drum 11 with writing light modulated depending on image data so as to form an electrostatic latent image. When a part on which the electrostatic latent image is formed by rotation of the photoconductive drum 11 reaches a position at which the part faces the developing device 14, toner charged with a negative electric charge is attracted from the developing device 14 to the electrostatic latent image and the electrostatic latent image is developed by the toner so as to form a toner image on the photoconductive drum 11.

When reaching a position at which the toner image formed on the photoconductive drum 11 faces the primary transfer roller 15 across the intermediate transfer belt 2, the toner image is attracted to a side of the intermediate transfer belt 2 by action of a high voltage applied from a high-voltage power source 19 to the primary transfer roller 15 and is transferred (primarily transferred) on the intermediate transfer belt 2. After the static eliminator 16 removes an electric charge on a surface of the photoconductive drum 11 that has finished primary transfer of the toner image, charging processing for a next operation is performed on the photoconductive drum 11. In this case, the cleaning blade 17 removes foreign substances such as residual toner remaining on the intermediate transfer belt 2 without being transferred so as not to generate any influence on the next operation (abnormal image due to residual toner and the like).

In the image forming device 1, by sequentially transferring a toner image formed by each of the four image forming units 10 corresponding to four colors of Y, M, C, and K on the intermediate transfer belt 2 at the same timing with running of the intermediate transfer belt 2, the toner images of four colors are superimposed so as to form a full-color toner image on an intermediate transfer belt 130.

By contrast, a recording medium is provided from the paper feeding tray 5 at the same timing with running of the intermediate transfer belt 2. The recording medium provided from the paper feeding tray 5 is conveyed along with a conveying path indicated by a broken line in FIG. 1, and is synchronized with the full-color toner image formed on the intermediate transfer belt 2 so as to reach a position at which the recording medium faces the secondary transfer roller 3. The full-color toner image formed on the intermediate transfer belt 2 is transferred (secondarily transferred) on the recording medium by action of a high voltage applied to the secondary transfer roller 3.

The recording medium on which the full-color toner image is transferred is conveyed to the fixing device 4. Heat and pressure given by the fixing device 4 cause the full-color toner image transferred on the recording medium to be fixed on the recording medium. The recording medium on which the toner image is fixed is ejected from the image forming device 1.

As described above, in the image forming device 1 of the present embodiment, the cleaning blade 17 is provided to each of the image forming units 10, and bringing the tip of the cleaning blade 17 into contact with a surface of the photoconductive drum 11 driven to rotate causes residual toner remaining on the surface of the photoconductive drum 11 without being transferred to the intermediate transfer belt 2 to be removed. In this case, when friction between the tip of the cleaning blade 17 and the photoconductive drum 11 becomes excessive, the tip of the cleaning blade 17 may be reversed along with rotation of the photoconductive drum 11 and abnormality referred to as blade turn-up may occur.

For example, when a large volume of images having a small amount of toner consumption (images having a small toner area) are continuously copied, a toner amount remaining at the tip of the cleaning blade 17 and contributing to lubrication action becomes small and friction between the tip of the cleaning blade 17 and the photoconductive drum 11 becomes extremely large. In this case, blade turn-up may occur. When abnormality of blade turn-up occurs in the cleaning blade 17, cleaning performance is considerably degraded. Thus, the image forming device 1 of the present embodiment has a function of determining abnormality of this kind of blade turn-up with accuracy.

When abnormality of blade turn-up occurs in the cleaning blade 17, contact pressure of the cleaning blade 17 on the photoconductive drum 11 increases. As the contact pressure of the cleaning blade 17 on the photoconductive drum 11 increases, driving torque of a motor driving the photoconductive drum 11 to rotate increases with an increase in friction coefficient. In addition, as blade turn-up causes contact pressure of the cleaning blade 17 on the photoconductive drum 11 to increase, the cleaning blade 17 pushes the photoconductive drum 11 in a direction in which the photoconductive drum 11 is separated from the charging roller 12, and a gap between the photoconductive drum 11 and the charging roller 12 (hereinafter referred to as a "charging roller gap") is widened.

Figure 3A:
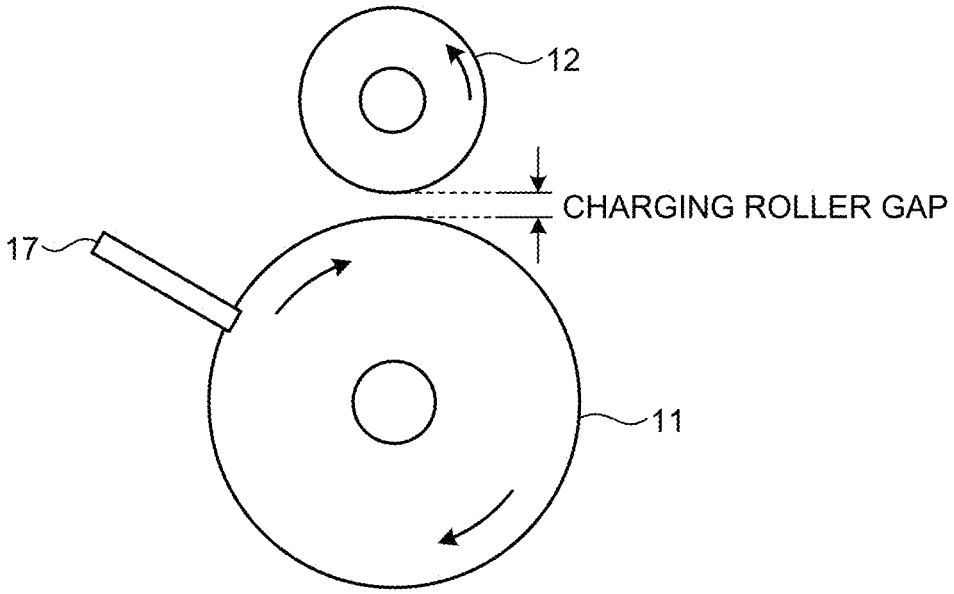
FIG. 3A is a view illustrating a change in a charging roller gap due to blade turn-up.
Figure 3B:
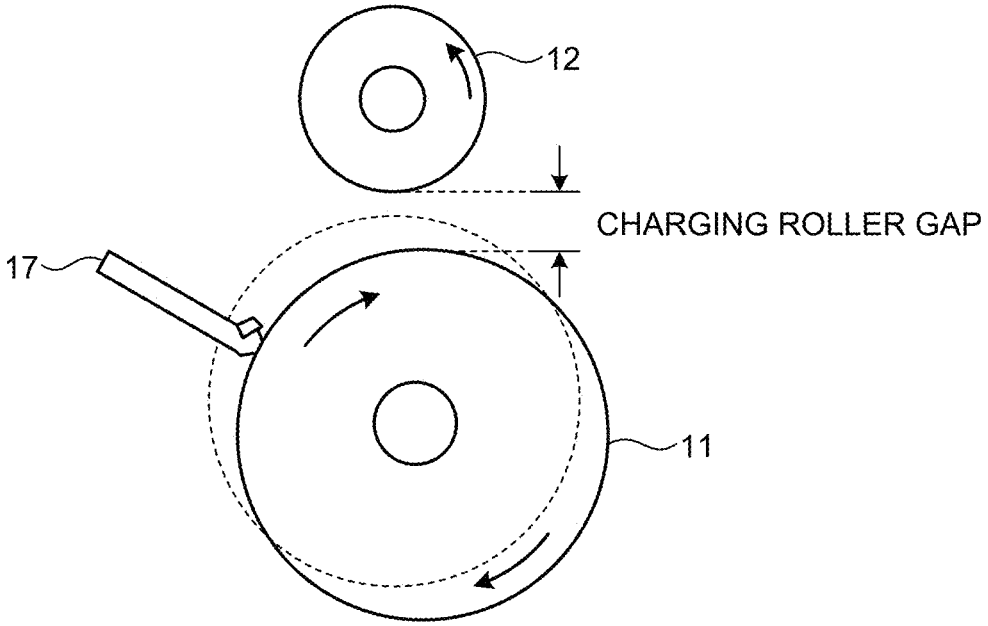
FIG. 3B is a view illustrating a change in a charging roller gap due to blade turn-up.

FIGS. 3A and 3B are views illustrating a change in a charging roller gap due to blade turn-up. In a normal state, as illustrated in FIG. 3A, the photoconductive drum 11 and the charging roller 12 are arranged so as to keep a constant charging roller gap. Bringing the tip of the cleaning blade 17 into contact with a surface of the photoconductive drum 11 causes residual toner remaining on the surface of the photoconductive drum 11 to be removed.

When abnormality of blade turn-up occurs in the cleaning blade 17, contact pressure of the cleaning blade 17 on the photoconductive drum 11 increases, and the cleaning blade 17 pushes the photoconductive drum 11 in a direction in which the photoconductive drum 11 is separated from the charging roller 12 as illustrated in FIG. 3B with an increase in driving torque of a motor driving the photoconductive drum 11 to rotate so as to widen the charging roller gap. A change in driving torque of a motor driving the photoconductive drum 11 to rotate can be detected as a change in motor current flowing in this motor.

Figure 4:
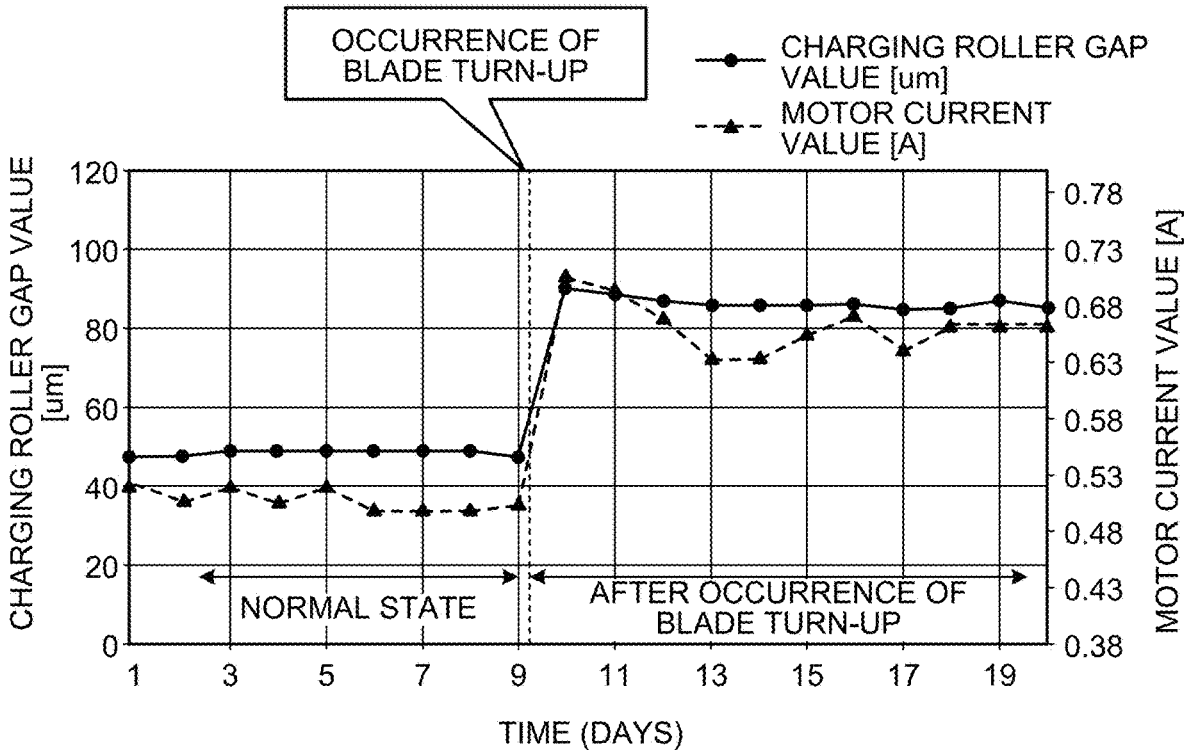
FIG. 4 is a graph illustrating a result of a charging roller gap and a motor current observed day by day.

FIG. 4 is a graph illustrating a result of a charging roller gap and a motor current observed day by day in the image forming unit 10 having the configuration described above. In the example illustrated in FIG. 4, blade turn-up in the cleaning blade 17 occurs between the ninth day and the tenth day from the observation start. The observation result illustrated in this FIG. 4 indicates that both a value of the charging roller gap (charging roller gap value) and a value of the motor current (motor current value) increase after occurrence of the blade turn-up of the cleaning blade 17 than before the occurrence of the blade turn-up.

In the present embodiment, the image forming device 1 is made to have a function of determining whether abnormality of blade turn-up occurs in the cleaning blade 17 based on a motor current flowing in a motor driving the photoconductive drum 11 to rotate and a charging roller gap between the photoconductive drum 11 and the charging roller 12.

Figure 5:
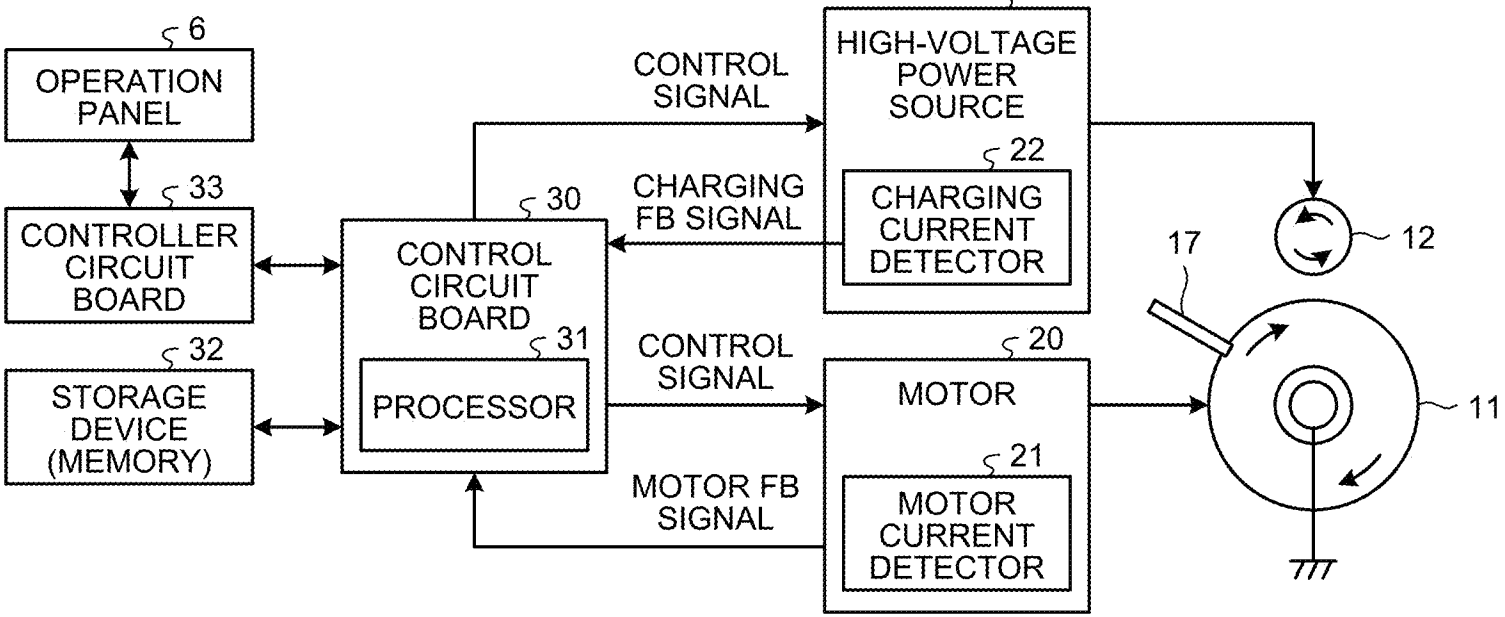
FIG. 5 is a diagram illustrating the configuration of a main part in the image forming device related to abnormality determination of a cleaning blade.

FIG. 5 is a diagram illustrating the configuration of a main part in the image forming device 1 related to abnormality determination of the cleaning blade 17. In the present embodiment, as illustrated in FIG. 5, a motor 20 driving the photoconductive drum 11 to rotate is provided with a motor current detector 21 that detects a motor current. The high-voltage power source 18 applying a high voltage to the charging roller 12 is provided with a charging current detector 22 that detects an output current (charging current) of the high-voltage power source 18.

The motor 20 rotates at a rotating speed corresponding to a control signal sent from a control substrate 30, and drives the photoconductive drum 11. In this case, a motor current flowing in the motor 20 is detected as needed by the motor current detector 21, and the detected motor current value is sent as a motor feedback (FB) signal corresponding to an analog signal to the control circuit board 30.

Depending on a control signal sent from the control circuit board 30, the high-voltage power source 18 generates a high voltage in which an alternating-current (AC) voltage is superimposed on a direct-current (DC) voltage, and applies the generated high voltage to the charging roller 12. In this case, an output current (charging current) of the high-voltage power source 18 is detected as needed by the charging current detector 22, the detected charging current value is converted into a voltage value, and the converted voltage value is sent as a charging feedback (FB) signal corresponding to an analog signal to the control circuit board 30.

The control circuit board 30 outputs a control signal to the high-voltage power source 18 and the motor 20, and controls operations of these high-voltage power source 18 and the motor 20. The control circuit board 30 includes a processor 31 such as a central processing unit (CPU), and this processor 31 performs arithmetic processing based on a charging FB signal sent from the charging current detector 22 and a motor FB signal sent from the motor current detector 21.

A storage device 32 stores therein information used by the processor 31 in the control circuit board 30 for an arithmetic operation and information on an arithmetic operation result. The storage device 32 stores therein, for example, a motor current value indicated by a motor FB signal, a characteristic expression for obtaining a charging roller gap value from a voltage value indicated by a charging FB signal, a charging roller gap value that is calculated from a voltage value indicated by a charging FB signal using this characteristic expression, and a threshold value used for determination.

A controller circuit board 33 controls the whole image forming device 1, and indicates an interface (I/F) function with the outside and the start and end of image formation, manages various kinds of time, and the like. The operation panel 6 described above is connected to this controller circuit board 33.

In the image forming device 1 of the present embodiment, the processor 31 in the control circuit board 30 has a function as an abnormality determining unit that determines abnormality of the cleaning blade 17 based on a motor current and a charging roller gap.

Figure 6:
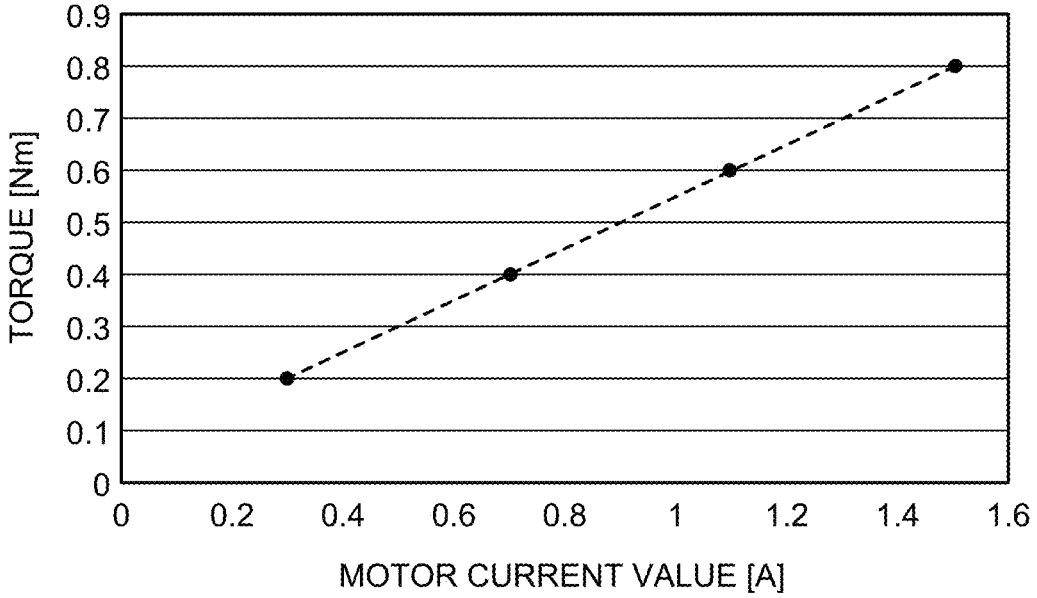
FIG. 6 is a characteristic view illustrating relation between a motor current and driving torque of a motor.

When abnormality of blade turn-up occurs in the cleaning blade 17, as described above, driving torque of the motor 20 driving the photoconductive drum 11 to rotate increases. As the driving torque of the motor 20 increases, a motor current flowing in the motor 20 increases. FIG. 6 is an example of a characteristic view illustrating relation between a motor current and driving torque of the motor 20. The motor current and the driving torque of the motor 20 have linear characteristics as illustrated in FIG. 6, and it turns out that the motor current increases with an increase in driving torque.

Figure 7:
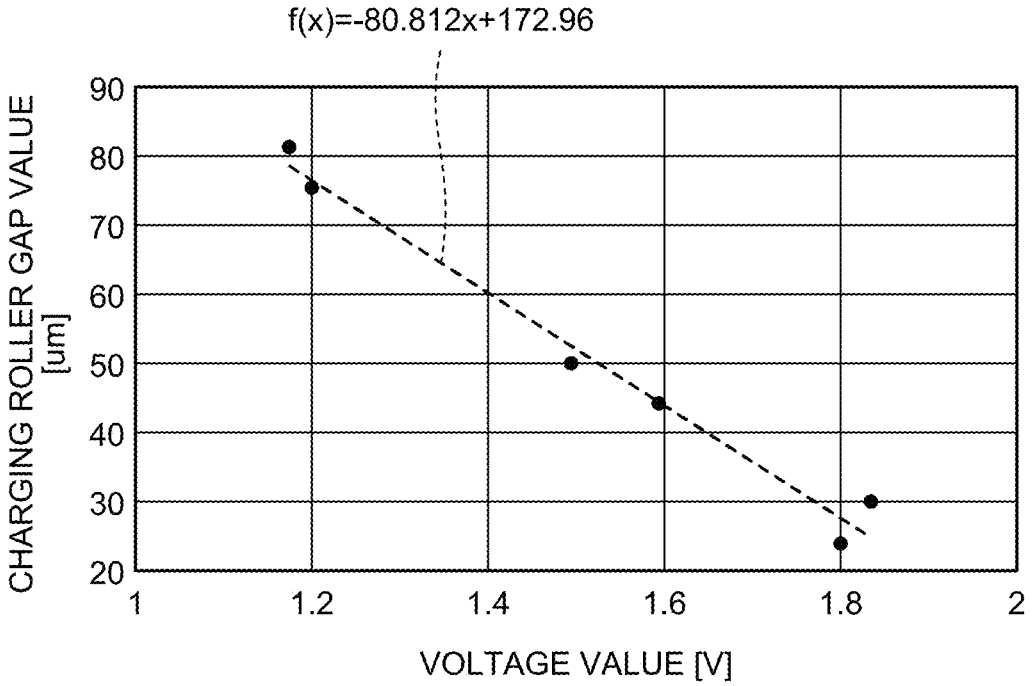
FIG. 7 is a characteristic view illustrating relation between a voltage value converted from a charging current and a charging roller gap.

When abnormality of blade turn-up occurs in the cleaning blade 17, as described above, a charging roller gap is widened. As a charging roller gap is widened, a charging current output by the high-voltage power source 18 decreases and a voltage value converted from this charging current becomes small. FIG. 7 is an example of a characteristic view illustrating relation between a voltage value converted from a charging current and a charging roller gap. The charging roller gap and the voltage value converted from a charging current have linear characteristics as illustrated in FIG. 7, and the charging roller gap can be obtained from the voltage value converted from a charging current using a characteristic expression f(x) serving as a linear transformation function.

In the present embodiment, a characteristic expression indicating relation between this charging roller gap and the voltage value converted from a charging current is preliminarily obtained and is stored in the storage device 32. The processor 31 (abnormality determining unit) in the control circuit board 30 can obtain the charging roller gap value from the voltage value indicated by a charging FB signal from the charging current detector 22 using this characteristic expression. For example, as illustrated in the example in FIG. 7, the characteristic expression indicating relation between the charging roller gap and the voltage value converted from a charging current represents $f(x)=-80.812x+172.96$, and the charging roller gap value is, when the voltage value indicated by a charging FB signal is 1.4 [v], calculated as $-80.812\times1.4+172.96=59.8232$ [μm].

The processor 31 can determine whether abnormality of blade turn-up occurs in the cleaning blade 17 by comparing, for example, the motor current value indicated by a motor FB signal with a predetermined threshold value and the charging roller gap value calculated based on a voltage value indicated by a charging FB signal with a predetermined threshold value. For example, when the motor current value is equal to or greater than a first threshold value (for example, 0.65 [A]) and the charging roller gap value is equal to or greater than a second threshold value (for example, 80 [μm]), the processor 31 determines that abnormality of blade turn-up is present in the cleaning blade 17. When the motor current value is equal to or greater than the first threshold value and the charging roller gap value is less than the second threshold value, the processor 31 determines that abnormality such as failure is present in the motor 20. When the motor current value is less than the first threshold value and the charging roller gap value is equal to or greater than the second threshold value, the processor 31 determines that abnormality such as failure is present in the charging roller 12. When the motor current value is less than the first threshold value and the charging roller gap value is less than the second threshold value, the processor 31 determines that abnormality is not present.

In the image forming device 1 of the present embodiment, when the processor 31 determines that any one of the abnormality of blade turn-up in the cleaning blade 17, the abnormality such as failure of the motor 20, and the abnormality such as failure of the charging roller 12 occurs, for example, the control circuit board 30 sends a signal indicating occurrence of abnormality to the controller circuit board 33, and warning for occurrence of abnormality and contents of abnormality are displayed on the operation panel 6. In this manner, a user using the image forming device 1 can recognize occurrence of abnormality and make a necessary response depending on contents of the abnormality. When the processor 31 determines that abnormality of blade turn-up in the cleaning blade 17 occurs, as described in Japanese Unexamined Patent Application Publication No. 2004-258419, a user may take actions such as an action of inputting untransferred toner so as to reduce friction between the cleaning blade 17 and the photoconductive drum 11.

Figure 8:
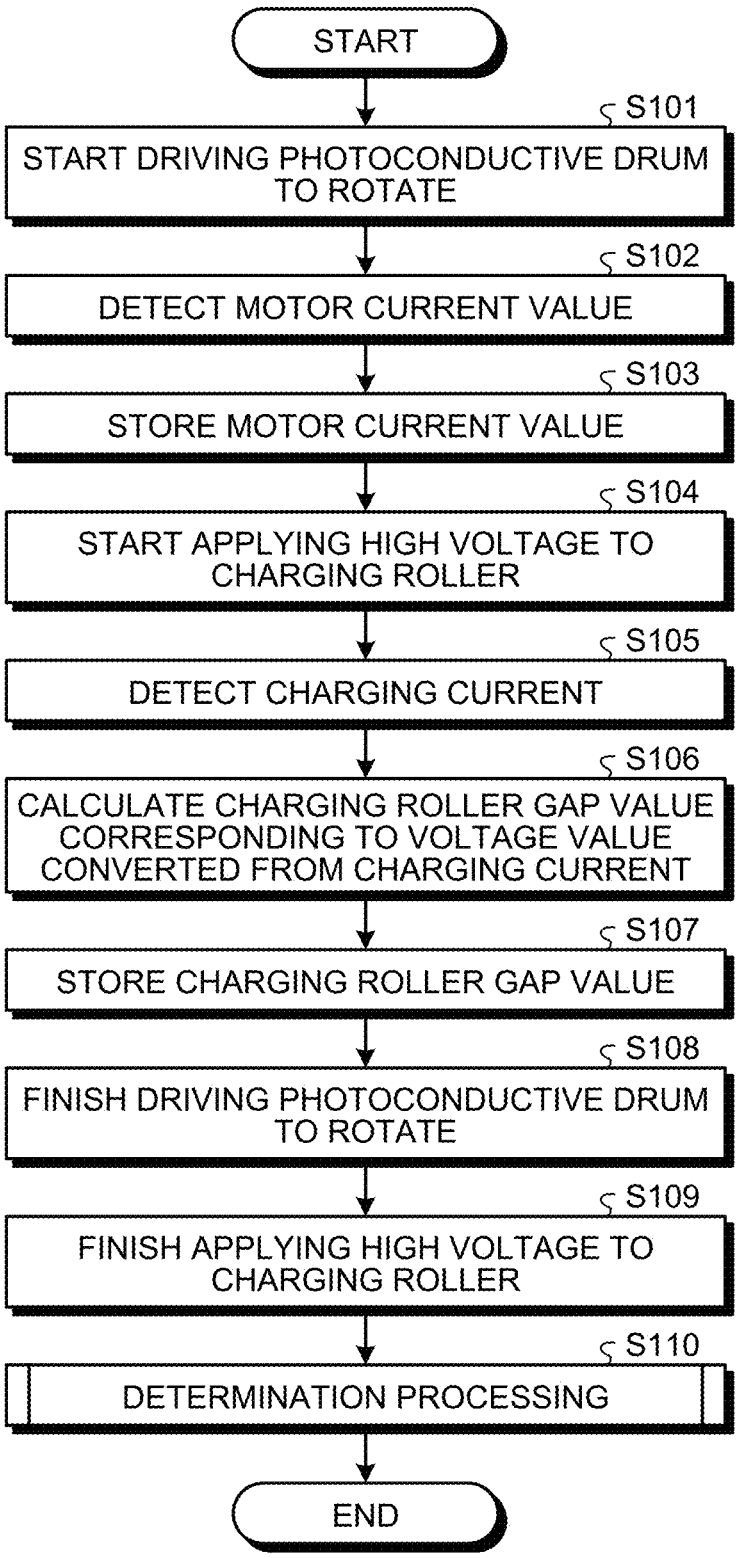
FIG. 8 is a flowchart illustrating a flow for operations of the image forming device that determines abnormality.
Figure 9:
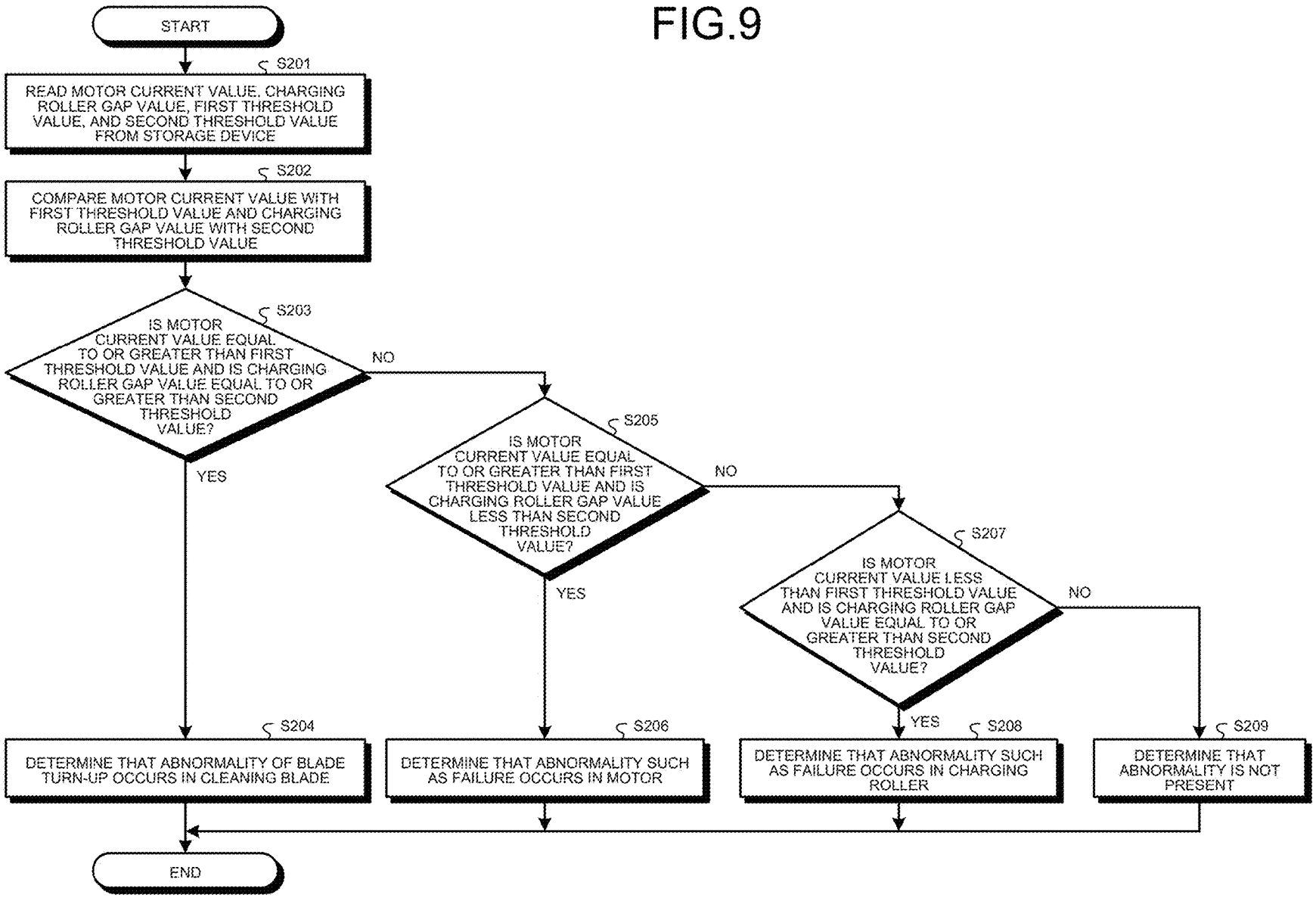
FIG. 9 is a flowchart illustrating a specific example of determination processing.

The following describes operations of the image forming device 1 that determines abnormality described above with reference to FIGS. 8 and 9. FIG. 8 is a flowchart illustrating a flow for operations of the image forming device 1 that determines abnormality. FIG. 9 is a flowchart illustrating a specific example of determination processing.

When the image forming device 1 starts an operation, the control circuit board 30 sends a control signal to the motor 20 and the motor 20 starts driving the photoconductive drum 11 to rotate (step S101).

Subsequently, the motor current detector 21 detects a motor current value when the photoconductive drum 11 is driven to rotate, and sends the detected motor current value as a motor FB signal to the control circuit board 30 (step S102). The motor current value indicated by the motor FB signal is stored in the storage device 32 (step S103).

Subsequently, the control circuit board 30 sends a control signal to the high-voltage power source 18, and the high-voltage power source 18 starts applying a high voltage to the charging roller 12 (step S104).

Subsequently, the charging current detector 22 detects a charging current when the high-voltage power source 18 applies a high voltage to the charging roller 12, and converts the detected charging current into a voltage value and sends the converted voltage value as a charging FB signal to the control circuit board 30 (step S105).

Subsequently, the processor 31 in the control circuit board 30 calculates, from the voltage value indicated by the charging FB signal, a charging roller gap value corresponding to the voltage value using the characteristic expression described above (step S106). The calculated charging roller gap value is stored in the storage device (step S107).

After that, when the high-voltage power source 18 finishes application of a high voltage to the charging roller 12 (step S108) and the motor 20 finishes driving the photoconductive drum 11 to rotate (step S109), the processor 31 in the control circuit board 30 performs determination processing illustrated in FIG. 9 (step S110).

When starting determination processing, the processor 31 first reads the motor current value stored at step S103, the charging roller gap value stored at step S107, the first threshold value, and the second threshold value from the storage device 32 (step S201). The processor 31 compares the motor current value with the first threshold value and the charging roller gap value with the second threshold value (step S202).

When a result of this comparison indicates that the motor current value is equal to or greater than the first threshold value and the charging roller gap value is equal to or greater than the second threshold value (Yes at step S203), the processor 31 determines that abnormality of blade turn-up occurs in the cleaning blade 17 (step S204). When the motor current value is equal to or greater than the first threshold value and the charging roller gap value is less than the second threshold value (No at step S203 and Yes at step S205), the processor 31 determines that abnormality such as failure occurs in the motor 20 (step S206).

When the motor current value is less than the first threshold value and the charging roller gap value is equal to or greater than the second threshold value (No at step S205 and Yes at step S207), the processor 31 determines that abnormality such as failure occurs in the charging roller 12 (step S208). When the motor current value is less than the first threshold value and the charging roller gap value is less than the second threshold value (No at step S205 and No at step S207), the processor 31 determines that abnormality is not present (step S209).

As the specific example has been given and described in detail above, according to the present embodiment, abnormality in the cleaning blade 17 is determined based on a motor current that flows in the motor 20 driving the photoconductive drum 11 to rotate and a charging roller gap between the photoconductive drum 11 and the charging roller 12. For example, when a motor current value increases due to cause such as abnormality in the motor 20, it is not mistakenly determined that abnormality of blade turn-up occurs in the cleaning blade 17 and the abnormality in the cleaning blade 17 can be determined with accuracy.

According to the present embodiment, comparing the motor current value with the first threshold value and the charging roller gap value with the second threshold value enables blade turn-up of the cleaning blade 17, abnormality in the motor 20, and abnormality in the charging roller 12 to be isolated from each other, and enables presence or absence of the abnormality in the cleaning blade 17, the abnormality in the motor 20, and the abnormality in the charging roller 12 to be correctly determined.

The specific embodiment of the present invention has been described above, but the embodiment has been presented by way of an application example of the present invention. The present invention is not limited to the embodiment as it is, and can be embodied in an implementation phase by making various deformations and changes without departing from the spirit of the invention.

For example, in the embodiment, as an example of the image forming device to which the present invention is applied, the image forming device 1 of an intermediate transfer system that forms a full-color image of four colors is exemplified, but the present invention is not limited to the image forming device 1 having the configuration exemplified in the embodiment. The present invention can be widely applied to an image forming device of the electrophotographic system that has a cleaning unit for bringing a cleaning blade into contact with a surface of a photoconductor so as to remove residual toner.

According to an embodiment, abnormality of a cleaning blade can be determined with accuracy.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming device comprising:

a photoconductor;

a motor configured to drive the photoconductor to rotate;

a charging member configured to charge the photoconductor;

a cleaning blade configured to contact the photoconductor and remove residual toner from a surface of the photoconductor; and an abnormality determining unit configured to determine abnormality of the cleaning blade based on a motor current flowing in the motor and a gap between the photoconductor and the charging member.

2. The image forming device according to claim 1, further comprising:

a motor current detecting unit configured to detect the motor current; and a charging current detecting unit configured to detect an output current of a high-voltage power source configured to apply a high voltage to the charging member, wherein the gap is calculated based on a voltage value converted from a current value detected by the charging current detecting unit.

3. The image forming device according to claim 1, wherein the abnormality determining unit is configured to determine that abnormality of blade turn-up occurs in the cleaning blade, in a case where a value of the motor current is equal to or greater than a first threshold value and a value of the gap is equal to or greater than a second threshold value.

4. The image forming device according to claim 3, wherein the abnormality determining unit is configured to determine that abnormality is present in the motor, in a case where a value of the motor current is equal to or greater than the first threshold value and a value of the gap is less than the second threshold value, the abnormality determining unit is configured to determine that abnormality is present in the charging member, in a case where a value of the motor current is less than the first threshold value and a value of the gap is equal to or greater than the second threshold value, and the abnormality determining unit is configured to determine that abnormality is not present, in a case where a value of the motor current is less than the first threshold value and a value of the gap is less than the second threshold value.

5. A method for determining abnormality in an image forming device comprising:

a photoconductor;

a motor configured to drive the photoconductor to rotate;

a charging member configured to charge the photoconductor; and a cleaning blade configured to contact the photoconductor and remove residual toner from a surface of the photoconductor, wherein abnormality of the cleaning blade is determined based on a motor current flowing in the motor and a gap between the photoconductor and the charging member.

* * * * *